US011519674B2

(12) United States Patent
Wan et al.

(10) Patent No.: US 11,519,674 B2
(45) Date of Patent: Dec. 6, 2022

(54) GRAVITY HIGH-EFFICIENCY HEAT DISSIPATION APPARATUS

(71) Applicant: Man Zai Industrial CO., LTD., Tainan (TW)

(72) Inventors: Cheng-Chien Wan, Tainan (TW); Cheng-Jui Wan, Tainan (TW); Chun-Hsien Su, Tainan (TW); Hui-Fen Huang, Tainan (TW)

(73) Assignee: MAN ZAI INDUSTRIAL CO., LTD., Tainan (TW)

( * ) Notice: Subject to any disclaimer, the term of this patent is extended or adjusted under 35 U.S.C. 154(b) by 75 days.

(21) Appl. No.: 16/924,549

(22) Filed: Jul. 9, 2020

(65) Prior Publication Data

US 2021/0318073 A1 Oct. 14, 2021

(30) Foreign Application Priority Data

Apr. 13, 2020 (TW) ..... 109112312

(51) Int. Cl.
*F28D 15/02* (2006.01)
*F28D 15/04* (2006.01)

(52) U.S. Cl.
CPC ..... *F28D 15/025* (2013.01); *F28D 15/0266* (2013.01); *F28D 15/04* (2013.01)

(58) Field of Classification Search
CPC .... F28D 15/025; F28D 15/0266; F28D 15/04; F28D 1/0435; F28D 1/05308; F28D 1/05316; F28D 1/05333; F28D 1/05341; F28D 1/0535; F28D 1/05366; F28D 1/05383; F28D 1/05391
See application file for complete search history.

(56) References Cited

U.S. PATENT DOCUMENTS 8,345,425 B2 * 1/2013 Toyoda ..... F28D 1/05366 361/700
8,485,248 B2 * 7/2013 Coyle ..... F28F 1/022 165/174

(Continued)

FOREIGN PATENT DOCUMENTS

WO WO-2009086825 A2 * 7/2009 ..... F28D 15/0266

*Primary Examiner* — Tho V Duong
(74) *Attorney, Agent, or Firm* — Muncy, Geissler, Olds & Lowe, P.C.

(57) ABSTRACT

The present invention provides a gravity high-efficiency heat dissipation apparatus comprising an evaporator and a condenser. The evaporator comprises a housing, an evaporation chamber arranged at the housing, and a skived structure arranged inside the evaporation chamber. The condenser comprises an upper circulating main pipe, a lower circulating main pipe and one or a plurality of condensation pipes having an upper opening and a lower opening fluidly connected to the upper circulating main pipe and the lower circulating main pipe respectively. The upper circulating main pipe is fluidly connected to an upper side of the evaporator via a first connecting pipe and is fluidly connected to an upper side of the evaporation chamber. The lower circulating main pipe is fluidly connected to one side of the evaporator via a second connecting pipe and is fluidly connected to the evaporation chamber. A circumferential side of each of the condensation pipes has one or a plurality of heat dissipation fins formed thereon.

10 Claims, 10 Drawing Sheets

(56) References Cited

U.S. PATENT DOCUMENTS

| | | | | |
|---|---|---|---|---|
| 8,929,073 | B2 * | 1/2015 | Suzuki | F28D 15/046 361/700 |
| 2007/0284088 | A1 * | 12/2007 | Chun | F28D 15/046 165/104.21 |
| 2010/0071880 | A1 * | 3/2010 | Kim | F28D 15/0266 165/104.26 |
| 2011/0079376 | A1 * | 4/2011 | Loong | B23P 15/26 165/185 |
| 2011/0192574 | A1 * | 8/2011 | Yoshikawa | F28F 9/026 165/104.21 |
| 2015/0226498 | A1 * | 8/2015 | Park | F28D 1/05391 165/174 |
| 2016/0003545 | A1 * | 1/2016 | Taras | F28F 9/0214 165/143 |

* cited by examiner (a)

(b)

(c)

GRAVITY HIGH-EFFICIENCY HEAT DISSIPATION APPARATUS

BACKGROUND OF THE INVENTION

1. Technical Field

The present invention relates to a heat dissipation apparatus, in particular, to a gravity high-efficiency heat dissipation apparatus.

2. Description of Related Art

To process various computer information and data, electronic equipment is equipped with central processors, mainly used to process data of computer software and to execute various complicated computer program or computer commands. In addition, the computation processing speed and data transmission capacity of electronic equipment are closely related to the work performance of central processors.

During the computation process of data, central processors are known to generate a great amount of heat. When such heat cannot be dissipated timely but is accumulated over time, high temperature is likely to cause abnormality of the electronic equipment, such as reduced operating speed of the electronic equipment, slow reaction or hot crash etc. When electronic equipment is under a high temperature environment for a long period of time, the electronic components inside the equipment are likely to be damaged due to such temperature. Consequently, a portion of the electronic devices can be degraded early or the useful lifetime of the entire electronic equipment can be significantly shortened.

To allow electronic equipment to operate normally and stably, typically, a heat dissipation apparatus is installed at the location where heat is primarily generated in the electronic equipment, and heat conduction or heat convention method is utilized to dissipate the heat, thereby achieving the effect of temperature reduction and cooling in order to protect the electronic equipment. In general, a common cooling technique applied to a central processor is to install a fan. Through the utilization of a fan, the airflow volume is increased in order to achieve the effect of dissipating the heat generated by the central processor and the effects of temperature reduction and cooling. Nevertheless, when the temperature of the external environment is also under a high temperature state, the heat dissipation method with the use of fan cannot effectively and swiftly achieve the effects of temperature reduction and cooling for the electronic equipment. In view of the drawback associated with the prior art requiring an improvement to the cooling method of central processors, the inventor of the present invention seeks to provide a technique capable of improving the effects of temperature reduction and cooling for central processors.

BRIEF SUMMARY OF THE INVENTION

A primary objective of the present invention is to provide an apparatus capable of using its own gravity force of a liquid to improve the heat dissipation efficiency.

In order to achieve the above objective, the present invention provides a gravity high-efficiency heat dissipation apparatus, comprising: an evaporator comprising a housing, an evaporation chamber arranged at the housing, and a skived structure arranged inside the evaporation chamber; and a condenser comprising an upper circulating main pipe, a lower circulating main pipe and one or a plurality of condensation pipes having an upper opening and a lower opening fluidly connected to the upper circulating main pipe and the lower circulating main pipe respectively; wherein, the upper circulating main pipe is fluidly connected to an upper side of the evaporator via a first connecting pipe and is fluidly connected to an upper side of the evaporation chamber; the lower circulating main pipe is fluidly connected to one side of the evaporator via a second connecting pipe and is fluidly connected to the evaporation chamber; and a circumferential side of each of the condensation pipes has one or a plurality of heat dissipation fins formed thereon.

Furthermore, a height of the lower circulating main pipe is higher than a bottom side of the evaporation chamber.

Furthermore, each section of a space inside the second connecting pipe is higher than the bottom side of the evaporation chamber.

Furthermore, the upper circulating main pipe comprises an upper front guiding pipe and an upper rear guiding pipe arranged adjacent to the upper front guiding pipe, the first connecting pipe is connected to the upper front guiding pipe, a plurality of connecting channels are arranged between the upper front guiding pipe and the upper rear guiding pipe, and a plurality of connecting holes are individually arranged to penetrate through the connecting channels in order to connect to the internal spaces of the upper front guiding pipe and the upper rear guiding pipe.

Furthermore, the lower circulating main pipe comprises a lower front guiding pipe and a lower rear guiding pipe arranged adjacent to the lower front guiding pipe, the second connecting pipe is connected to the lower front guiding pipe, a plurality of connecting channels are arranged between the lower front guiding pipe and the lower rear guiding pipe, and a plurality of connecting holes are individually arranged to penetrate through the connecting channels in order to connect to the internal spaces of the lower front guiding pipe and the lower rear guiding pipe.

Furthermore, the skived structure comprises a plurality of skived fins, and a spacing between the skived fins is between 0.1 mm and 1.0 mm.

Furthermore, an inner side of the condensation pipe includes a plurality of partition walls integrally formed therein, and the partition walls divide the inner side of the condensation pipe into a plurality of capillary tubes.

Furthermore, a cross sectional width of the capillary tube is between 0.2 mm and 2 mm, and a cross sectional length of the capillary tube is between 0.2 mm and 2 mm.

Furthermore, a quantity of the partition walls is a value between ⅓ of the width and twice of the width of the condensation pipe in order to divide the inner side of the condensation pipe into a plurality of capillary tubes.

Furthermore, a bottom side of the housing includes a heat absorbing flat surface attached onto a high temperature device.

Furthermore, the heat absorbing flat surface is arranged on the bottom side of the housing corresponding to an opposite side of the skived structure.

Furthermore, the condensation pipes and the heat dissipation fins are made of aluminum material or copper material.

Comparing to the conventional techniques, the present invention has the following advantages:

The gravity high-efficiency heat dissipation apparatus of the present invention includes an evaporator and a condenser, and through the use of phase change of a working fluid during the heat absorption and heat release processes, temperature reduction and cooling of an electronic device can be achieved. The condenser of the present invention is configured to have upper and lower circulating main pipes with a height difference from each other in order to allow the working fluid in a liquid phase to continuously provide the driving force for the heat exchange cycle at the internal of the apparatus. Consequently, it is able to reduce the possibility of the working fluid in the gaseous phase transforming into the liquid phase due to the increase of the internal pressure at partial nodal locations (such as areas where a large aperture changes to a small aperture) of the apparatus under an overly filled state; thereby achieving an accelerated fluid circulation in order to maintain the efficiency of the heat exchange cycle.

DETAILED DESCRIPTION OF THE INVENTION

The details and technical solution of the present invention are hereunder described with reference to accompanying drawings. For illustrative sake, the accompanying drawings are not drawn to scale. The accompanying drawings and the scale thereof are not intended to be restrictive of the scope of the invention.

Figure 1:
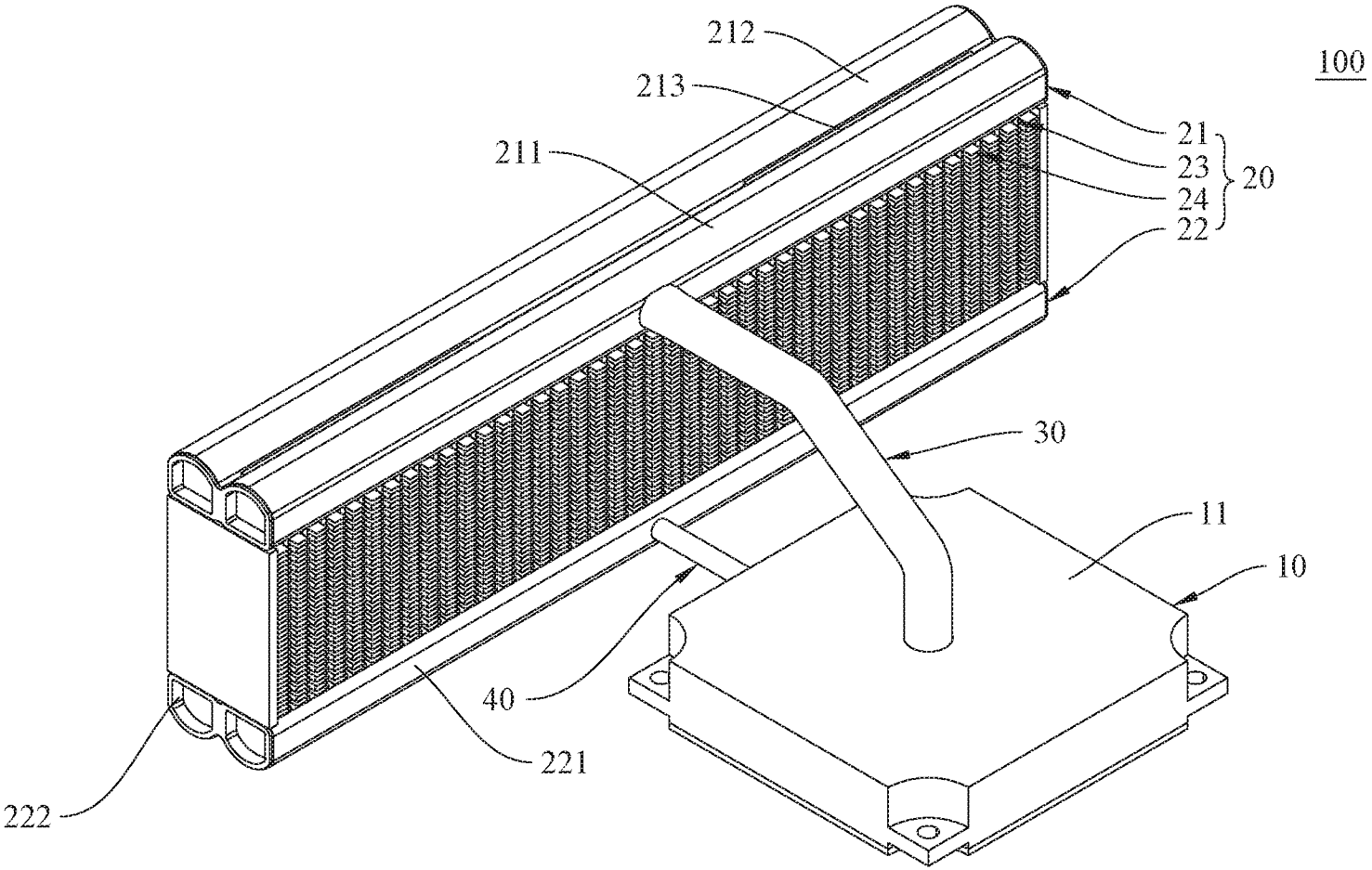
FIG. 1 shows an outer appearance perspective view of the gravity high-efficiency heat dissipation apparatus of the present invention.

Please refer to FIG. 1, showing an outer appearance perspective view of the gravity high-efficiency heat dissipation apparatus of the present invention.

The present invention provides a gravity high-efficiency heat dissipation apparatus 100, mainly applied to the fields of optics, communication, data processing, server, and so on where high-heat laminated circuits, nanometer integrated circuits, silicon optoelectronic chips, or any other chips with the same function as that of the aforementioned ones are typically required. The present invention can be used in the electronic products of servers, data displays, remote radio units (RRUs) for communication purposes, artificial intelligence (AI) devices, display chips or laser chips etc., and the present invention is able to utilize the heat exchange method of conduction, convention exchange or material etc. to achieve the heat dissipation effects of temperature reduction and cooling. The gravity high-efficiency heat dissipation apparatus 100 of the present invention has the merits of compact size and high heat dissipation efficiency such that it is applicable to electronic products with limited internal installation space.

The gravity high-efficiency heat dissipation apparatus 100 comprises an evaporator 10 and a condenser 20. A first connecting pipe 30 and a second connecting pipe 40 are arranged between the evaporator 10 and the condenser 20 for connection thereto. The phase change cycle of a working fluid during its heat absorption and heat release is utilized to achieve the temperature reduction and cooling of an electronic device, thereby preventing damage or reduction of work performance of the electronic components due to high temperature environment for a long period of time.

Figure 2:
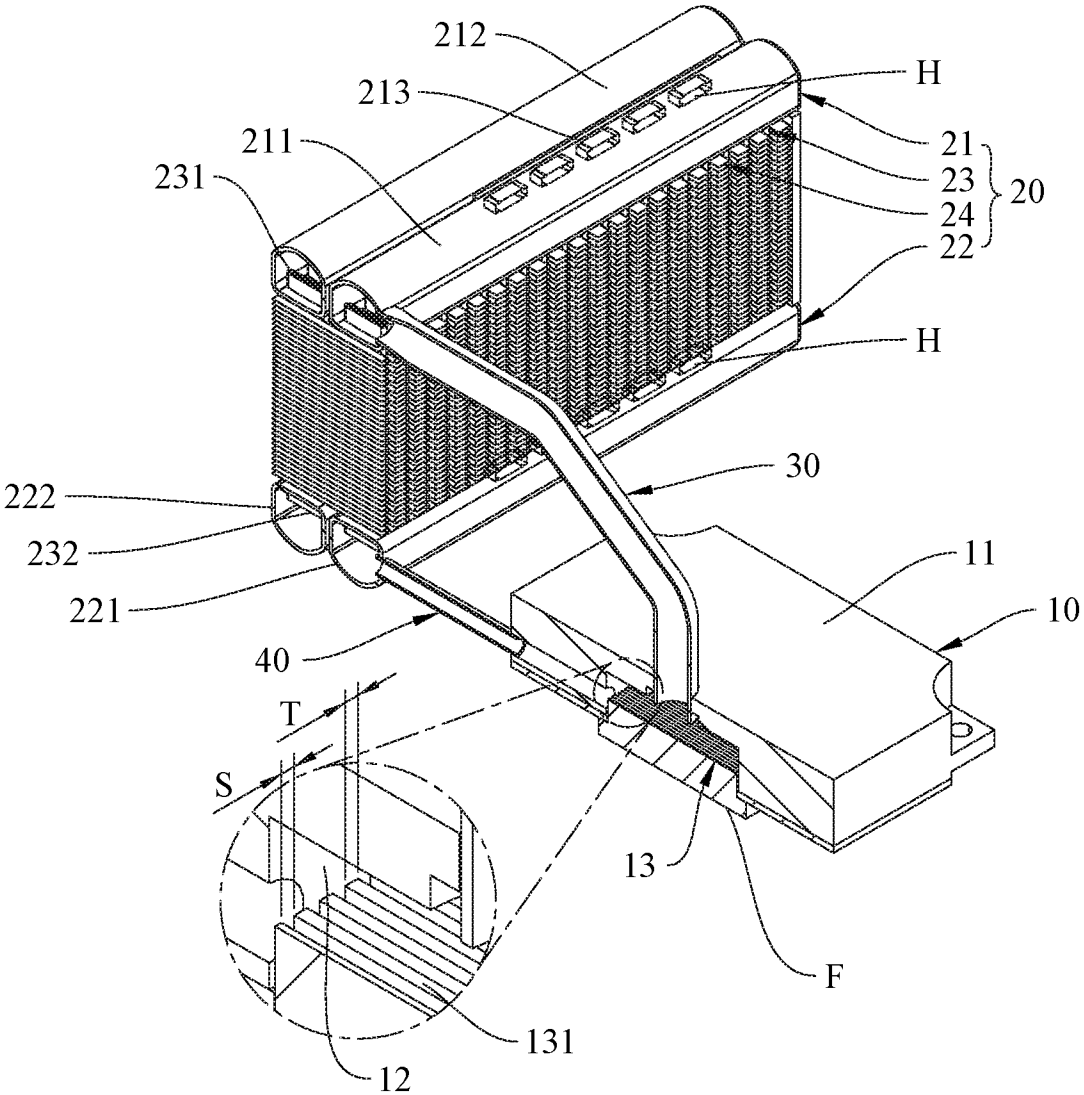
FIG. 2 shows a cross sectional view (I) of the gravity high-efficiency heat dissipation apparatus of the present invention.
Figure 3:
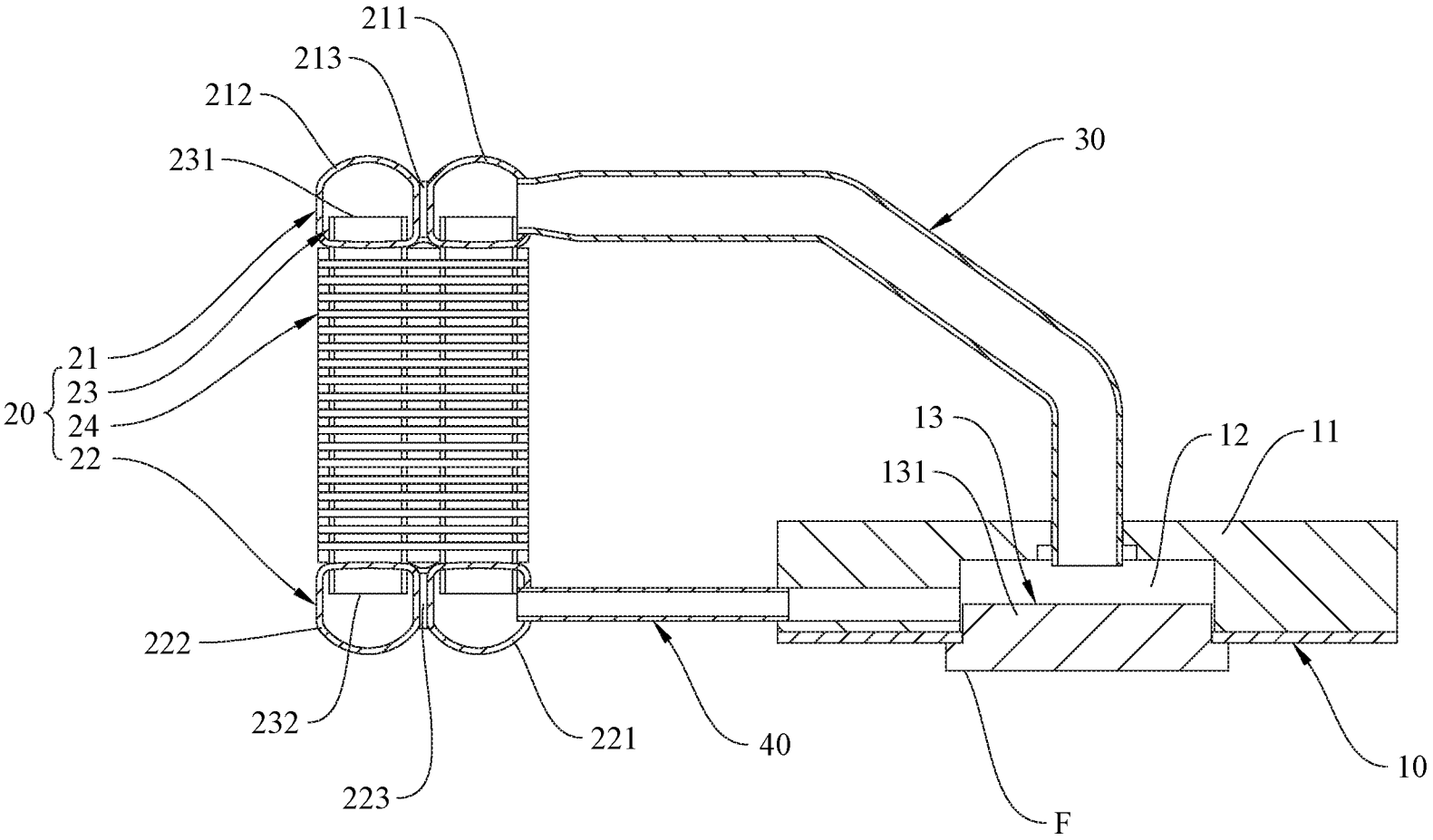
FIG. 3 shows a cross sectional view (II) of the gravity high-efficiency heat dissipation apparatus of the present invention.

Please further refer to FIG. 2 and FIG. 3, showing cross sectional views (I) and (II) of the gravity high-efficiency heat dissipation apparatus of the present invention viewed from different angles.

The evaporator 10 comprises a housing 11, an evaporation chamber 12 arranged at the housing 11 and a skived structure 13 arranged inside the evaporation chamber 12. The skived structure 13 comprises a plurality of skived fins 131, and a spacing S between the skived fins 131 can be between 0.1 mm and 1.0 mm in order to facilitate the working fluid in the liquid phase to flows through the spacing S between the skived fins 131, thereby achieving sufficient contact of the working fluid with the skived fins 131 in order to perform heat exchange. The skived fins 131 can be integrally formed inside the housing 11 via a skiving technique, and the thickness T of the skived fins 131 can be between 0.1 mm and 1 mm, thereby increasing the efficiency of the heat exchange between the skived fins 131 and the working fluid in the liquid phase. A bottom side of the housing 11 of the evaporator 10 includes a heat absorbing flat surface F attached onto an electronic product, and the heat absorbing flat surface F is arranged on the bottom side of the housing 11 corresponding to the opposite side of the skived structure 13 in order to absorb the heat generated by the electronic product.

The condenser 20 comprises an upper circulating main pipe 21, a lower circulating main pipe 22 and one or a plurality of condensation pipes 23 having an upper opening 231 and a lower opening 232 fluidly connected to the upper circulating main pipe 21 and the lower circulating main pipe 22 respectively. The upper circulating main pipe 21 is located on top of the lower circulating main pipe 22, i.e. there is a height difference between the two, in order to facilitate the working fluid in the gaseous phase in the upper circulating main pipe 21 to perform heat exchange to become the working fluid in the liquid phase, followed by allowing the working fluid in the liquid phase to be able to flow toward the lower circulating main pipe 22 underneath via its own weight. The apparatus is able to provide a siphon force therein in order to allow the apparatus to be able to perform the heat exchange cycle continuously without the need of additional installation of electrical devices. The height of the lower circulating main pipe 22 is higher than the bottom side of the evaporation chamber 12 in order to facilitate the working fluid in the liquid phase to be guided into the evaporator 10 while preventing the working fluid in the liquid phase to return or flow back into the condenser 20.

The upper circulating main pipe 21 is fluidly connected to an upper side of the evaporator 10 via the first connecting pipe 30 and is fluidly connected to an upper side of the evaporation chamber 12. The lower circulating main pipe 22 is fluidly connected to one side of the evaporator 10 via the second connecting pipe 40 and is fluidly connected to the evaporation chamber 12. The location where the first connecting pipe 30 is connected to the housing 11 is higher than the location where the second connecting pipe 40 is connected to the housing 11. In addition, each section of the space inside the second connecting pipe 40 is higher than the bottom side of the evaporation chamber 12. With the utilization of the aforementioned structural relationship and the siphon force provided by the own gravity force of the working fluid in the liquid phase inside the apparatus, a heat exchange cycle can be formed to continuously operate between the evaporator 10 and the condenser 20. A pipe diameter of the first connecting pipe 30 is greater than a pipe diameter of the second connecting pipe 40 in order to facilitate the working fluid in the liquid phase to use the own gravity force in the liquid phase to drive continuous heat exchange cycle inside the gravity high-efficiency heat dissipation apparatus 100.

The upper circulating main pipe 21 comprises an upper front guiding pipe 211 and an upper rear guiding pipe 212 arranged adjacent to the upper front guiding pipe 211. The first connecting pipe 30 is connected to the upper front guiding pipe 211. One or a plurality of connecting channels 213 are arranged between the upper front guiding pipe 211 and the upper rear guiding pipe 212, and a plurality of connecting holes H are individually arranged to penetrate through the connecting channels 213 in order to connect to the internal spaces of the upper front guiding pipe 211 and the upper rear guiding pipe 212. The connecting channels 213 can be arranged at the two ends between the upper front guiding pipe 211 and the upper rear guiding pipe 212 respectively. The first connecting pipe 30 can be connected to a central portion of the upper front guiding pipe 211. The working fluid in the gaseous phase entering into the upper front guiding pipe 211 via the first connecting pipe 30 is divided to flow toward the two ends, followed by entering into the upper rear guiding pipe 212 via the connecting holes H at the two ends, such that the working fluid in the gaseous phase is uniformly guided into the upper circulating main pipe 21 in order to achieve the heat dissipation efficiency.

The lower circulating main pipe 22 comprises a lower front guiding pipe 221 and a lower rear guiding pipe 222 arranged adjacent to the lower front guiding pipe 221. The second connecting pipe 40 is connected to the lower front guiding pipe 221. One or a plurality of connecting channels 223 are arranged between the lower front guiding pipe 221 and the lower rear guiding pipe 222, and a plurality of connecting holes H are individually arranged to penetrate through the connecting channels 223 in order to connect to the internal spaces of the lower front guiding pipe 221 and the lower rear guiding pipe 222. The connecting channels 223 can be arranged at the two ends between the lower front guiding pipe 221 and the lower rear guiding pipe 222 respectively. The second connecting pipe 40 can be connected to a central portion of the lower front guiding pipe 221. The working fluid in the liquid phase in the lower rear guiding pipe 222 guided into the lower front guiding pipe 221 via the connecting holes H at the two ends is able to converge toward the center, following which the second connecting pipe 40 is able to guide the working fluid in the liquid phase into the evaporator 10 in order to allow the working fluid to properly complete its phase change between the evaporator 10 and the condenser 20, thereby achieving the heat exchange cycle.

In another preferred embodiment, the upper circulating main pipe 21 and the lower circulating main pipe 22 can be a guiding pipe with one single channel, such that the upper circulating main pipe 21 and the lower circulating main pipe 22 can be formed by a plurality of sheets, integrally formed pipe member or any other single channel parts or components, and the present invention is not limited to such configurations only.

Figure 4:
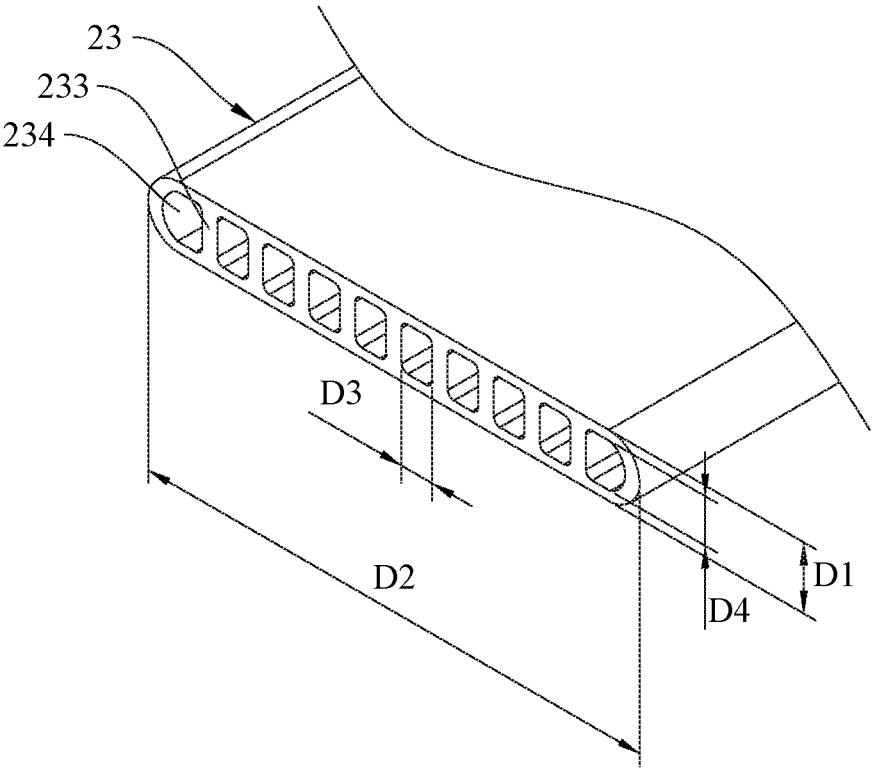
FIG. 4 shows an outer appearance view of the condensation pipe of the present invention.
Figure 5:
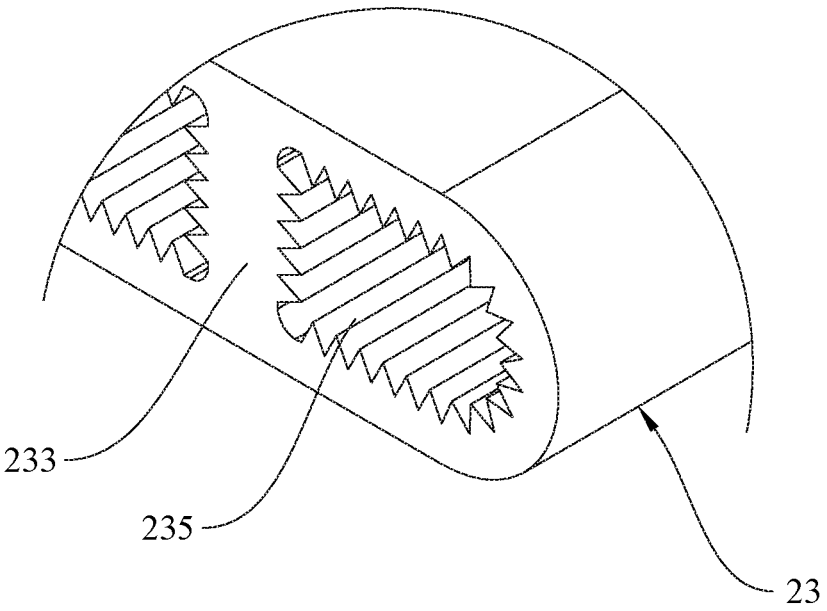
FIG. 5 shows a partially enlarged view of the condensation pipe of the present invention.
Figure 6:
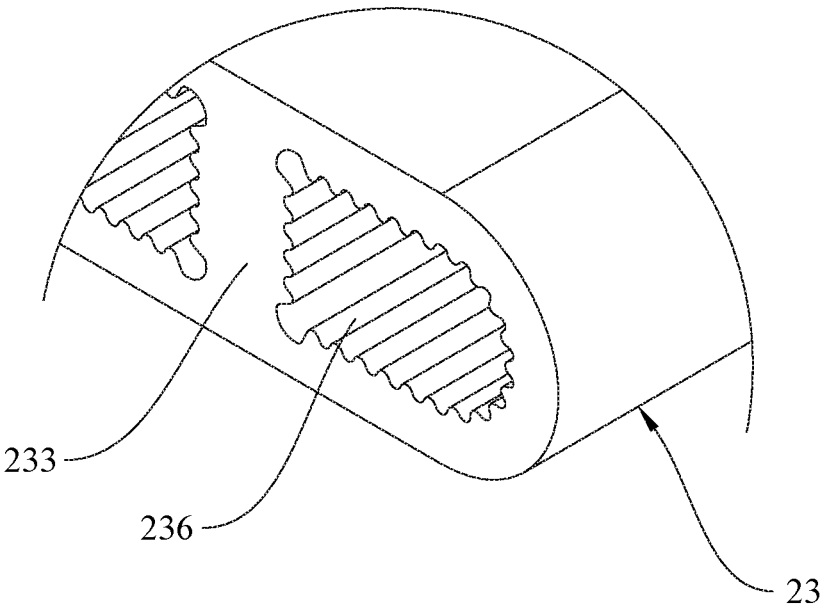
FIG. 6 shows a partially enlarged view of the condensation pipe of the present invention.

Next, please refer to FIG. 4 to FIG. 6, showing an outer appearance view and two partially enlarged views of the condensation pipe of the present invention.

As shown in the drawings, an inner side of the condensation pipe 23 can include a plurality of partition walls 233 integrally formed therein. The partition walls 233 are able to divide the inner side of the condensation pipe 23 into a plurality of capillary tubes 234. The condensation pipe 23 can be manufactured via an aluminum extrusion technique. The integrally formed condensation pipe 23 is able to withstand the high pressure generated when the working fluid flowing therethrough, and the cross section of the condensation pipe 23 is of a flat shape. A height D1 of the condensation pipe 23 can be between 1 mm and 3 mm in order to allow the working fluid to flow therethrough and to absorb heat sufficiently. In addition, a width D2 of the condensation pipe 23 can be between 12 mm and 40 mm in order to provide a greater heat dissipation area, thereby facilitating the contact between the air and the heat dissipation fins 24 in order to perform the heat exchange.

A cross sectional width D3 of the capillary tube 234 can be between 0.2 mm and 2 mm, and a cross sectional length D4 of the capillary tube 234 can be between 0.2 mm and 2 mm. The quantity of the capillary tubes 234 can be correlated to the quantity of the arrangement of the partition walls 233. The quantity of the partition walls 233 can be a value between ⅓ of the width and twice of the width of the condensation pipe 23. The width uses the unit of millimeter (mm) for the unit quantity arrangement; for example, when the width of the condensation pipe 23 is 12 mm, then the arrangement quantity of the partition walls 233 can be between 4 to 24 walls, thereby reinforcing the condensation pipe 23 structure to prevent deformation thereof. The interior of the condensation pipe 23 and the surface of the partition walls 233 can be flat surfaces (as shown in FIG. 4), or they can include a plurality of microstructures respectively; wherein the microstructures can be, such as, zigzag structure 235 (as shown in FIG. 5), corrugated structure 236 (as shown in FIG. 6), or capillary structure with mesh shape, fiber shape, groove shape or sintered structure, such that the contact surface between the interior of the condensation pipe 23 and the working fluid is increased in order to increase the heat dissipation efficiency.

Figure 7:
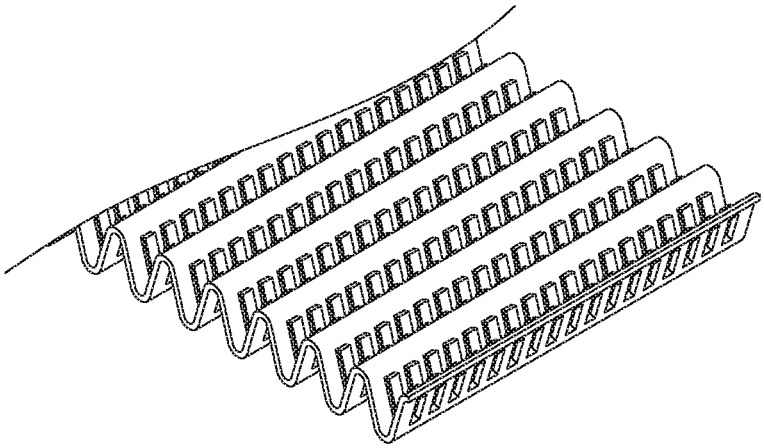
FIG. 7 shows outer appearance views of the heat dissipation fins according to different embodiments of the present invention.
Figure 7:
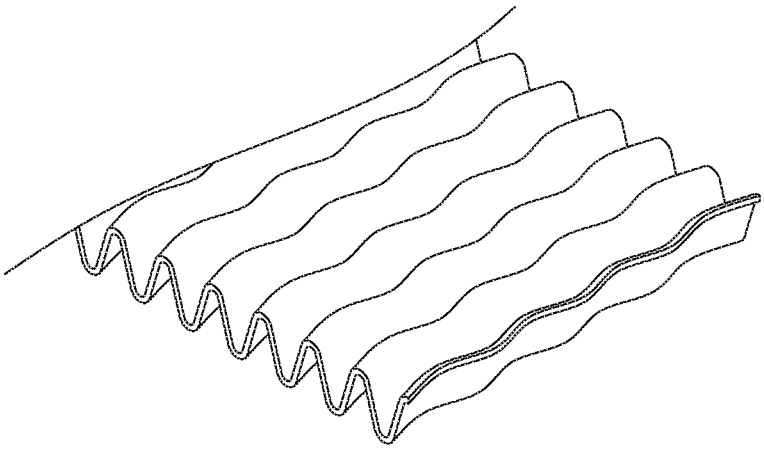
Figure 7:
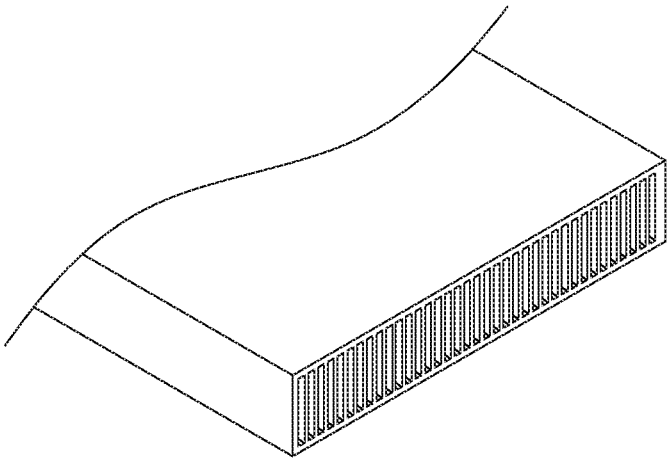

The circumferential side of each one of the condensation pipes 23 includes one or a plurality of heat dissipation fins 24 to facilitate the contact between the heat dissipation fins 24 and the condensation pipe 23 respectively in order to perform the heat exchange. The heat dissipation fins 24 can be arranged between two of the condensation pipes 23, or the condensation pipe 23 can be arranged to penetrate through the heat dissipation fins 24, and the present invention is not limited to such configurations only. The heat dissipation fins 24 can have the fin structure of roller fins (as shown in FIG. 7(*a*)), wave fins (as shown in FIG. 7(*b*)), or any other specific embodiments and configurations that can be achieved through bending of a metal sheet, or the heat dissipation fins 24 can be latched or stacked fins (as shown in FIG. 7(*c*)), and the present invention is not limited to such configurations only. The surface of each one of the heat dissipation fins 24 can further include a plurality of microstructures formed thereon. The microstructure can be a structure protruding outward or indented inward on the heat dissipation fin 24 (as shown in FIG. 7(*a*)). Alternatively, the microstructures can further include opening slots such that the microstructures can be used to increase the turbulence effect in order to increase the contact area between the heat dissipation fins 24 and the air, thereby increasing the heat dissipation efficiency. It shall be noted that the present invention is not limited to any specific embodiments and configurations. Furthermore, the aforementioned roller shape, wave shape, stacked shape or other forms of the heat dissipation fins 24 can have different types of microstructures depending upon the heat dissipation needs.

The condensation pipes 23 and the heat dissipation fins 24 can be made of an aluminum material. When the two are both made of an aluminum material, they are able to achieve a relatively higher heat dissipation efficiency. In addition to the use of the aluminum material, the condensation pipes 23 and the heat dissipation fins 24 can also be made of other materials, such as copper material, aluminum alloy or other metals capable of performing the heat exchange. The condensation pipes 23 and the heat dissipation fins 24 can also use different metal materials for the implementation in practice, and the present invention is not limited to any specific configurations and embodiments.

Figure 8:
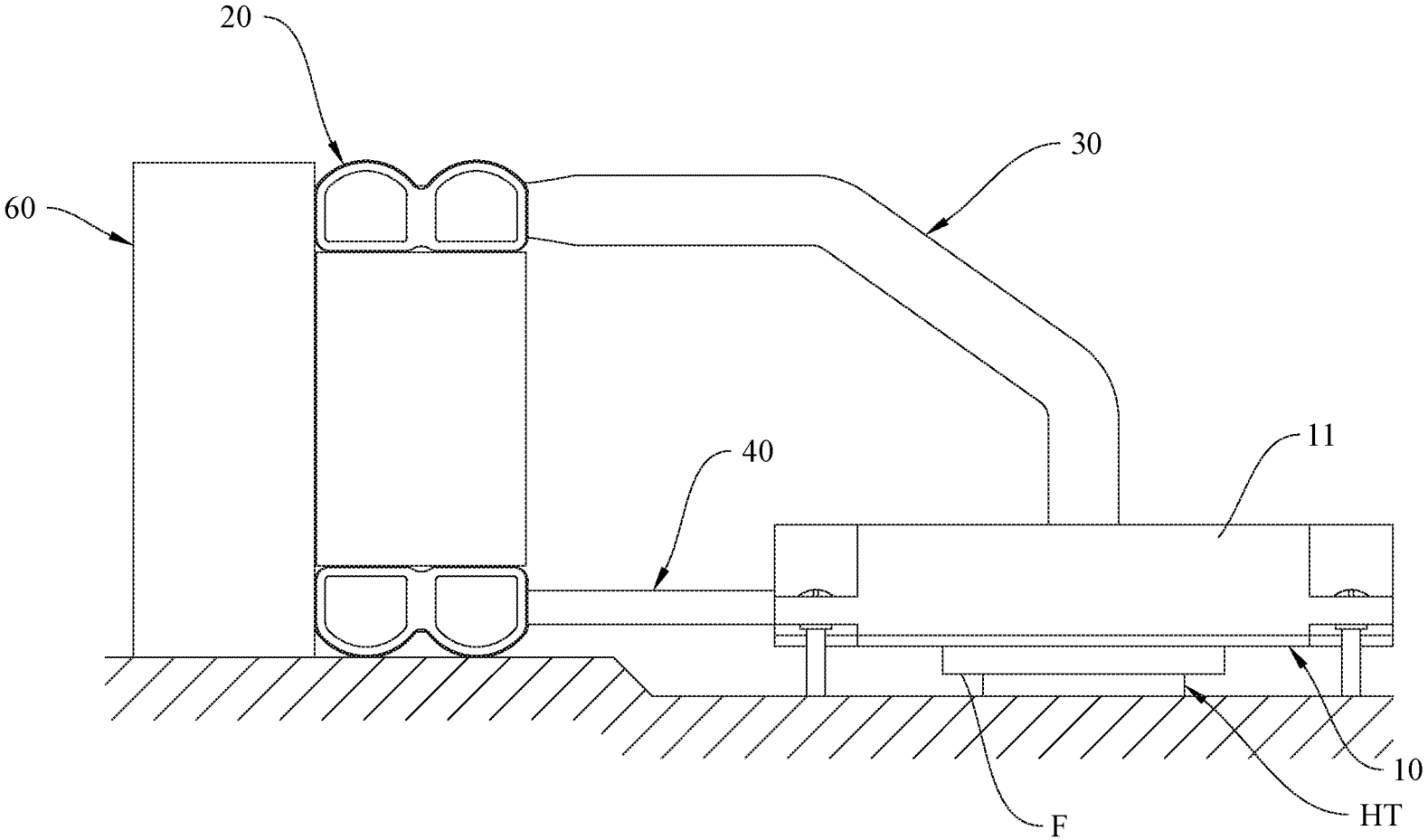
FIG. 8 shows a working state schematic view of the gravity high-efficiency heat dissipation apparatus of the present invention.
Figure 9:
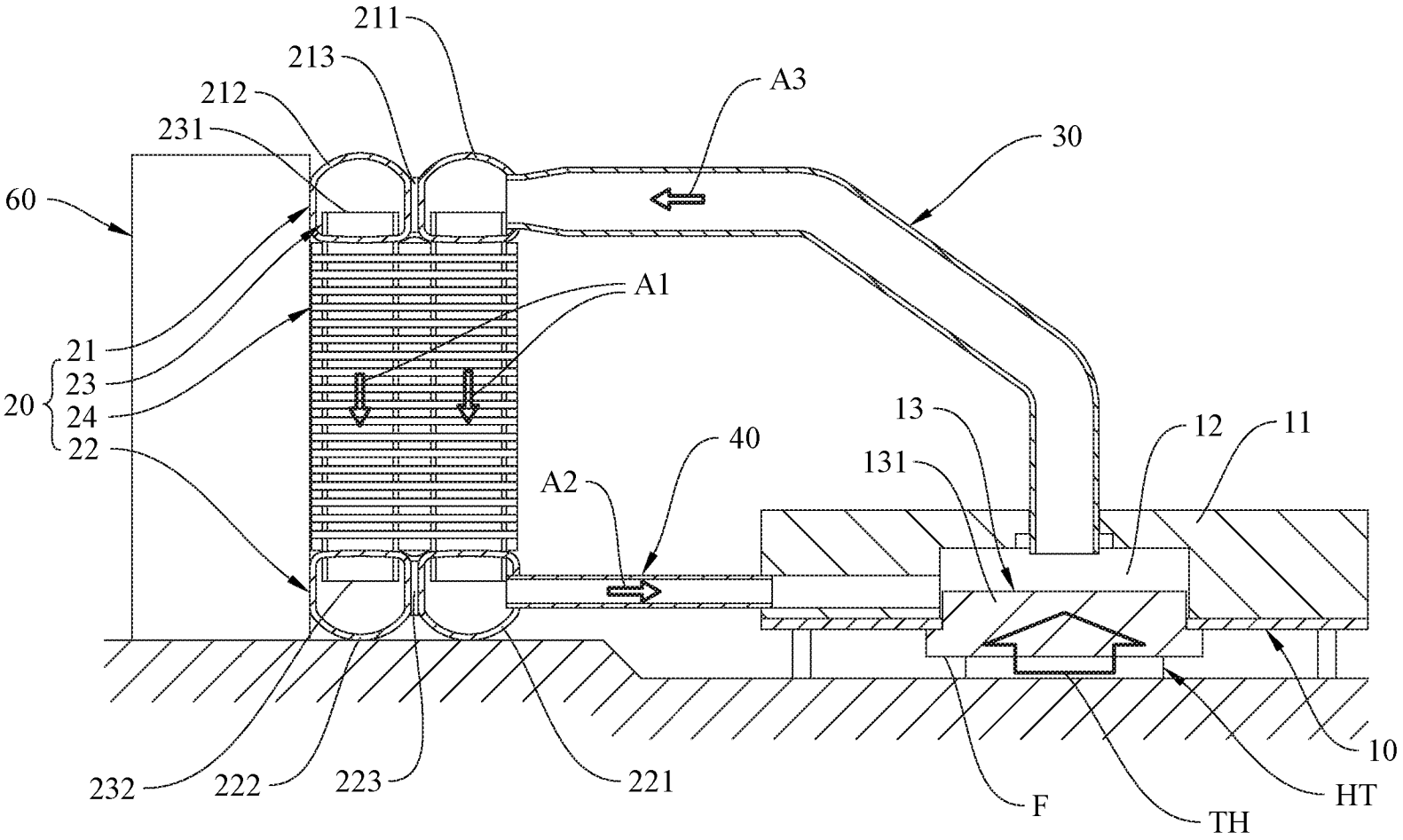
FIG. 9 shows a circulation schematic view of the gravity high-efficiency heat dissipation apparatus of the present invention.

Next, please refer to FIG. 8 and FIG. 9, showing a working state schematic view and a circulation schematic view of the gravity high-efficiency heat dissipation apparatus of the present invention.

The heat absorbing flat surface F of the bottom side of the evaporator 10 is attached onto a high temperature device HT in order to absorb the heat TH generated by the high temperature device HT, and the condenser 20 includes a fan 60 installed at one side opposite from the evaporator 10 in order to allow the condenser 20 adjacent to the fan 60 to obtain the maximum air volume, thereby increasing the heat dissipation efficiency at the evaporation end and the condensation end.

During the actual application, after the working fluid inside the upper circulating main pipe 21 performs the heat exchange, it transforms from the gaseous phase to the liquid phase. In addition, due to the own gravity force of the working fluid in the liquid phase and the height difference between the upper circulating main pipe 21 and the lower circulating main pipe 22, the working fluid in the liquid phase is able to flow toward the lower circulating main pipe 22 (as shown by the arrow A1). Next, since the location of the lower circulating main pipe 22 is higher than that of the evaporator 10, the working fluid in the liquid phase is able to be guided to flow into the evaporator 10 (as shown by the arrow A2) through its own gravity force. In addition, under the effect of the siphon force provided by the flow due to the aforementioned gravity force of the working fluid in the liquid phase, the working fluid in the gaseous phase is guided to flow into the condenser 20 (as shown by arrow A3), allowing the working fluid in the gaseous phase to flow into the condenser 20 to perform the heat exchange. In addition, after the completion of the phase change, the working fluid in the liquid phase is able to flow toward the lower circulating main pipe 22 (as shown by arrow A1 again). Consequently, under the condition where no other electrical devices are installed, the phase change of the working fluid during the heat absorption and heat release can be utilized to continuously provide the driving force to perform the heat exchange cycle inside the apparatus.

After experimental tests, the heat dissipation effect of the gravity high-efficiency heat dissipation apparatus 100 of the present invention is as shown in the following table:

The following table refers to the tests performed under the experimental condition for the chip power of 300 watt (W):

| Air Volume (CFM) | Ventilation Impedance (mmAq) | Thermal Resistance (R) |
|---|---|---|
| 40 | 2.00 | 0.0900 |
| 60 | 3.78 | 0.0765 |
| 80 | 5.98 | 0.0686 |
| 100 | 8.40 | 0.0663 |
| 120 | 11.20 | 0.0639 |
| 140 | 14.32 | 0.0603 |

The following table refers to the test performed under the experimental condition for the chip power of 600 watt (W):

| Air Volume (CFM) | Ventilation Impedance (mmAq) | Thermal Resistance (R) |
|---|---|---|
| 40 | 2.08 | 0.0913 |
| 60 | 3.90 | 0.0759 |
| 80 | 6.12 | 0.0687 |
| 100 | 8.54 | 0.0651 |
| 120 | 11.38 | 0.0618 |
| 140 | 14.50 | 0.0603 |

According to the above experimental results, it can be understood that under the condition where the chip power is 300 W and 600 W respectively, it demonstrates to have steady state and the same thermal resistance values in both examples, and the thermal resistance values obtained are lower than the ones of a conventional heat dissipation module. Under the conditions of other air volume and pressure, the thermal resistance values can also be controlled to be below 0.1, indicating that the present invention achieves outstanding performance in the heat dissipation efficiency.

Figure 10:
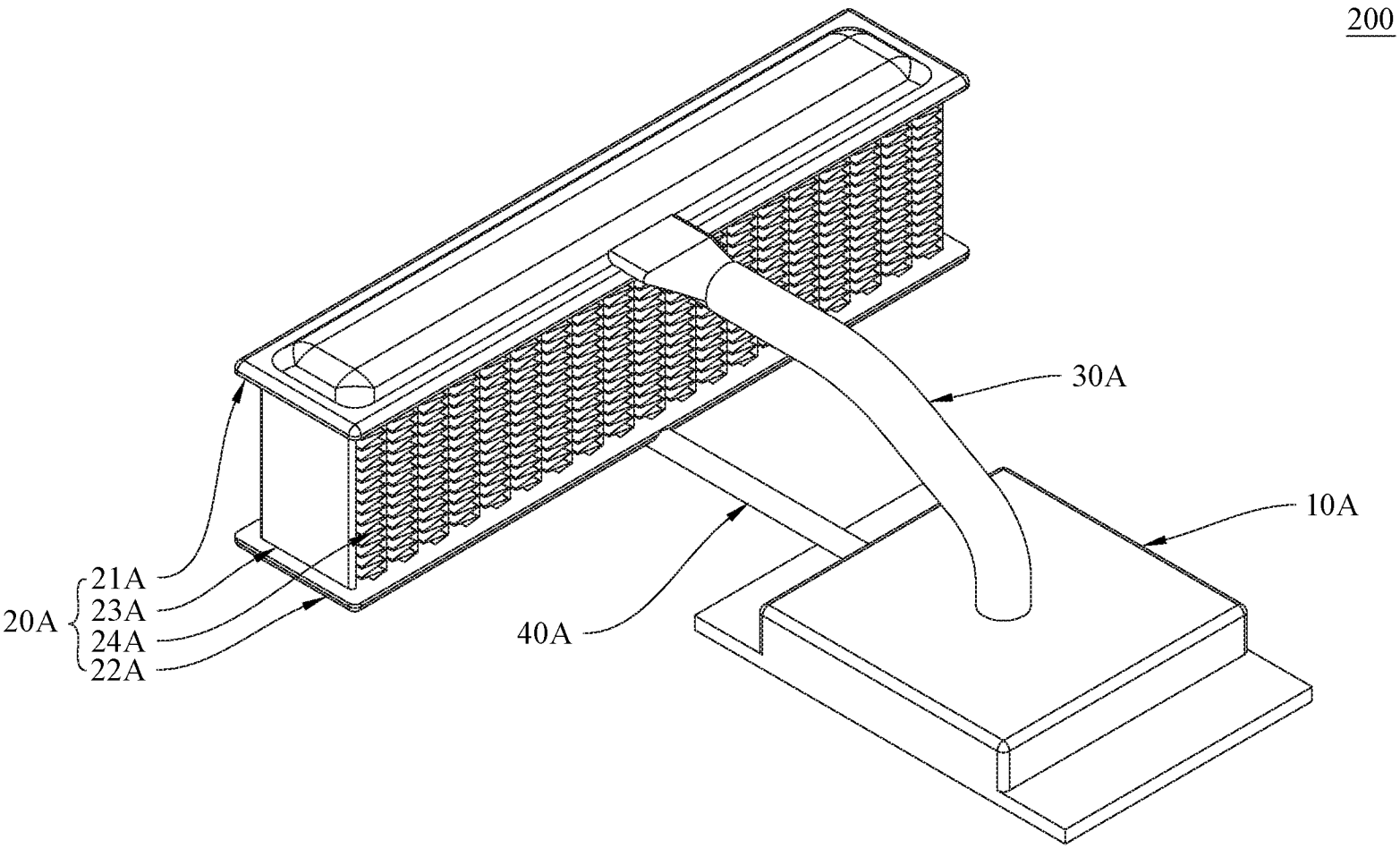
FIG. 10 shows an outer appearance view of another embodiment of the gravity high-efficiency heat dissipation apparatus of the present invention.

Furthermore, please refer to FIG. 10, showing an outer appearance view of another embodiment of the gravity high-efficiency heat dissipation apparatus of the present invention. The difference between this embodiment and the previous embodiment mainly relies in the internal structure of the upper and lower circulating main pipes of the condenser. Please note that the parts of the same structure are omitted in the description of the following paragraphs for conciseness.

The present invention further provides a gravity high-efficiency heat dissipation apparatus 200, comprising an evaporator 10A, a condenser 20A and a first connecting pipe 30A and a second connecting pipe 40A arranged between the evaporator 10A and the condenser 20A for connection thereto. The condenser 20A comprises an upper circulating main pipe 21A, a lower circulating main pipe 22A, one or a plurality of condensation pipes 23A respectively connected to the upper circulating main pipe 21A and the lower circulating main pipe 22A, and one or a plurality of heat dissipation fins 24A arranged at a circumferential side of the condensation pipe 23A. In addition, the upper circulating main pipe 21A and the lower circulating main pipe 22A respectively includes a single channel to allow a working fluid to pass therethrough. To be more specific, the upper circulating main pipe 21A and the lower circulating main pipe 22A can be formed by a plurality of sheets, integrally formed pipe member or any other single channel parts or components, and the present invention is not limited to such configurations only.

In view of the above, the gravity high-efficiency heat dissipation apparatus of the present invention is able to utilize the own gravity force of the working fluid in the liquid phase to provide the driving force capable of driving the working fluid in the gaseous phase and the working fluid in the liquid phase to perform heat exchange cycle continuously inside the apparatus, in order to reduce the possibility of the working fluid in the gaseous phase transforming into the liquid phase due to the increase of the internal pressure at partial nodal locations (such as areas where a large aperture changes to a small aperture) of the apparatus under an overly filled state; thereby achieving an accelerated fluid circulation in order to maintain the efficiency of the heat exchange cycle.

While the present invention has been described in connection with certain exemplary embodiments, it is to be understood that the invention is not limited to the disclosed embodiments, but, on the contrary, intended to cover various modifications and equivalent arrangements included within the spirit and scope of the appended claims and equivalents thereof.

What is claimed is:

1. A gravity high-efficiency heat dissipation apparatus, comprising:

an evaporator comprising a housing, an evaporation chamber arranged at the housing, and a skived structure arranged inside the evaporation chamber; and a condenser comprising an upper circulating main pipe, a lower circulating main pipe and one or a plurality of condensation pipes having an upper opening and a lower opening fluidly connected to the upper circulating main pipe and the lower circulating main pipe respectively; wherein, the upper circulating main pipe is fluidly connected to an upper side of the evaporator via a first connecting pipe and is fluidly connected to an upper side of the evaporation chamber; the lower circulating main pipe is fluidly connected to one side of the evaporator via a second connecting pipe and is fluidly connected to the evaporation chamber; and a circumferential side of each of the condensation pipes has one or a plurality of heat dissipation fins formed thereon;

wherein the upper circulating main pipe comprises an upper front guiding pipe and an upper rear guiding pipe arranged adjacent to the upper front guiding pipe, the first connecting pipe is connected to a central portion with symmetry of the upper front guiding pipe, a plurality of connecting channels are arranged between the upper front guiding pipe and the upper rear guiding pipe, and a plurality of connecting holes are individually arranged to penetrate through the connecting channels in order to connect to the internal spaces of the upper front guiding pipe and the upper rear guiding pipe;

wherein the lower circulating main pipe comprises a lower front guiding pipe and a lower rear guiding pipe arranged adjacent to the lower front guiding pipe, the second connecting pipe is connected to a central portion with symmetry of the lower front guiding pipe, a plurality of connecting channels are arranged between the lower front guiding pipe and the lower rear guiding pipe, and a plurality of connecting holes are individually arranged to penetrate through the connecting channels in order to connect to the internal spaces of the lower front guiding pipe and the lower rear guiding pipe;

wherein each of the upper front guiding pipe, the upper rear guiding pipe, the lower front guiding pipe, and the lower rear guiding pipe has only one chamber.

2. The gravity high-efficiency heat dissipation apparatus of claim 1, wherein a height of the lower circulating main pipe is higher than a bottom side of the evaporation chamber.

3. The gravity high-efficiency heat dissipation apparatus of claim 2, wherein each section of a space inside the second connecting pipe is higher than the bottom side of the evaporation chamber.

4. The gravity high-efficiency heat dissipation apparatus of claim 1, wherein the skived structure comprises a plurality of skived fins, and a spacing between the skived fins is between 0.1 mm and 1.0 mm.

5. The gravity high-efficiency heat dissipation apparatus of claim 1, wherein an inner side of the condensation pipe includes a plurality of partition walls integrally formed therein, and the partition walls divide the inner side of the condensation pipe into a plurality of capillary tubes.

6. The gravity high-efficiency heat dissipation apparatus of claim 5, wherein a cross sectional width of the capillary tube is between 0.2 mm and 2 mm, and a cross sectional length of the capillary tube is between 0.2 mm and 2 mm.

7. The gravity high-efficiency heat dissipation apparatus of claim 5, wherein a quantity of the partition walls is a value between ⅓ of the width divided by 1 mm and twice of the width divided by 1 mm of the condensation pipe in order to divide the inner side of the condensation pipe into a plurality of capillary tubes.

8. The gravity high-efficiency heat dissipation apparatus of claim 1, wherein a bottom side of the housing includes a heat absorbing flat surface attached onto a high temperature device.

9. The gravity high-efficiency heat dissipation apparatus of claim 8, wherein the heat absorbing flat surface is arranged on the bottom side of the housing corresponding to an opposite side of the skived structure.

10. The gravity high-efficiency heat dissipation apparatus of claim 1, wherein the condensation pipes and the heat dissipation fins are made of aluminum material or copper material.

* * * * *